United States Patent [19]

Furuta

[11] 4,119,241

[45] Oct. 10, 1978

[54] CRYOGENIC LIQUEFIED GAS TANK OF THE MEMBRANE TYPE

[75] Inventor: Kazuhisa Furuta, Tokyo, Japan

[73] Assignee: Bridgestone Liquefied Gas Co. Ltd., Tokyo, Japan

[21] Appl. No.: 804,161

[22] Filed: Jun. 6, 1977

[30] Foreign Application Priority Data

Jun. 18, 1976 [JP] Japan ..... 51-72048

[51] Int. Cl.[2] ..... B65D 25/18

[52] U.S. Cl. ..... 220/439; 114/74 A

[58] Field of Search ..... 220/9 LG, 63 R, 71, 220/73; 114/74 A; 248/146

[56] References Cited

U.S. PATENT DOCUMENTS 3,613,932 10/1971 Yamamoto ..... 220/9 LG
3,712,500 1/1973 Marchaj ..... 220/9 LG
3,767,150 10/1973 Tabata ..... 114/74 A

FOREIGN PATENT DOCUMENTS 1,229,119 11/1966 Fed. Rep. of Germany ..... 220/9 LG
28,077 8/1971 Japan ..... 220/9 LG

*Primary Examiner*—William Price
*Assistant Examiner*—Joseph M. Moy
*Attorney, Agent, or Firm*—Stevens, Davis, Miller & Mosher

[57] ABSTRACT

A cryogenic liquefied gas tank of the membrane type including an inner membranous vessel having rounded corner portions, wherein the rounded corner portions are supported by saddle elements which are shifted by thermosensitive expansion and contraction rod means in accordance with the change of temperature of the membranous vessel so as to always fit the corner portions.

4 Claims, 5 Drawing Figures

FIG. 3
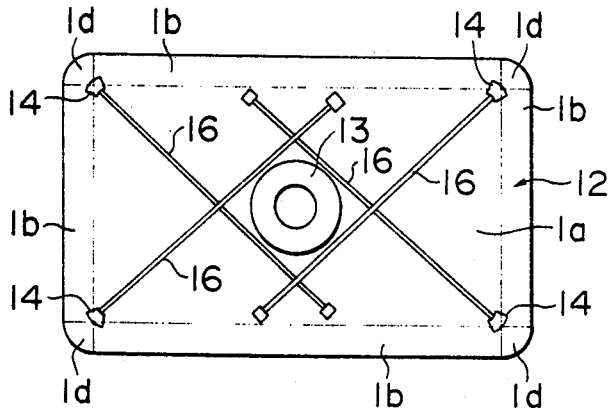
FIG. 4
FIG. 5
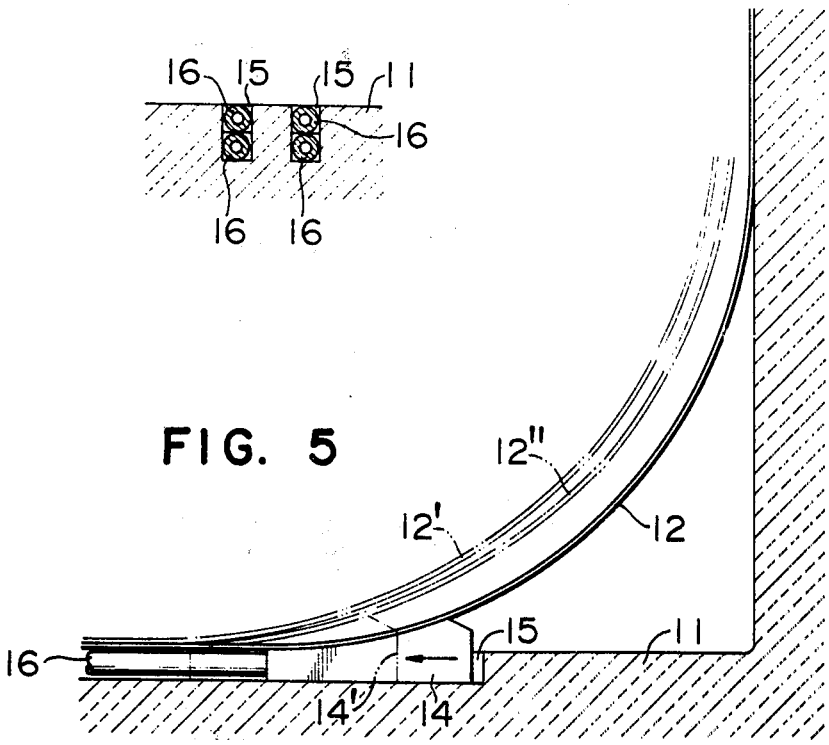

CRYOGENIC LIQUEFIED GAS TANK OF THE MEMBRANE TYPE

BACKGROUND OF THE INVENTION

1. Field of the Invention

The present invention relates to a cryogenic liquefied gas tank of the membrane type for storing cryogenic liquefied gases which are in the gaseous state at room temperature and are liquefied by refrigeration at atmospheric pressure.

2. Description of the Prior Art

The cryogenic liquefied gas tank of the membrane type generally comprises a rigid outer shell, a compression resistant heat insulating layer provided at the inside of said outer shell and a membranous vessel provided at the inside of said heat insulating layer, said membranous vessel being relatively flexible so that it tightly contacts the inner surface of the heat insulating layer when an internal pressure is applied to the membranous vessel, whereby the internal pressure is supported by the rigid outer shell by way of the compression resistant heat insulating layer. As a kind of such cryogenic liquefied gas tanks of the membrane type, the tank of a semi-membrane type is known, wherein the membranous vessel is not so thick as to support the internal pressure by itself but is thick enough to stand by its own rigidity in the room temperature no load condition. When the tank has a hexahedral shape, the membranous vessel is generally formed to have a shape such as shown in FIG. 1, wherein the membranous vessel comprises six face portions 1*a*, eight curved horizontal edge portions 1*b*, four curved vertical edge portions 1*c* and eight corner portions 1*d*, the last portions being generally called "ball corner". When the inner membranous vessel is loaded with cryogenic liquefied gases, the six base portions are substantially in contact with the heat insultaing layer. Furthermore, the curved horizontal edge portions located at the bottom portion of the inner membranous vessel are generally supported by correspondingly curved edge portions formed in the compression resistant heat insulating layer. However, the other curved edge portions and the corner portions are not directly supported by the heat insulating layer but are supported by adjacent portions of the membranous vessel itself, depending upon the hoop tension of the membrane.

When a tank of the aforementioned structure is constructed in a manner such that the inner membranous vessel just contacts the heat insulating layer at room temperature, the inner membranous vessel first contracts and separates from the heat insulating layer when refrigerated by the initial charge of cryogenic liquefied gases, and then the membranous vessel is expanded by the internal pressure or hydraulic pressure so as to again contact the heat insulating layer when charged with the full load of cryogenic liquefied gases. Under this condition, the border portions among the face portion, the curved edge portion and the ball corner portion, such as shown by A in FIG. 1, undergo a high stress which is principally a high bending stress combined with some axial stress.

In order to reduce this stress it is conventionally adopted that the radius of the ball corner portion is increased, that the ball corner portion is designed in some complex shape changed from the pure spherical shape, or that the inner membranous vessel is made a little larger than the internal dimension of the heat insulating layer by an amount which compensates for the thermal contraction of the inner membranous vessel due to refrigeration by cryogenic liquefied gases. However, it is disadvantageous to increase the radius of the ball corner portions, because it reduces the effective volume of the tank, while the other methods require complicated manufacturing processes and cause an increase of the manufacturing costs. As still another method of reducing the aforementioned stress caused at the vicinity of the corner portion, it is known to provide a saddle element adapted to support the corner portion, particularly the joining portion of the corner portion, the face portion and the curved edge portions such as shown by A in FIG. 1. However, if the saddle element is so positioned as to give support to the corner portion of the membranous vessel at cryogenic temperatures, the saddle element does not sufficiently move to a point suitable for supporting the corner portion at the time of a hydraulic pressure test held at room temperature prior to commencement of filling the completed tank with cryogenic liquefied gases, and the corner portion of the inner membraneous vessel is pressed against the saddle element thereby causing a local deformation of the corner portion due to an irregular contact with the saddle element. On the other hand, if the saddle element is adapted to properly fit the corner portion of the membranous vessel at room temperature, it remains separated from the corner portion of the inner membranous vessel in the cryogenic operating condition and is rendered ineffective.

SUMMARY OF THE INVENTION

It is therefore the object of the present invention to provide a cryogenic liquefied gas tank of the membrane type which incorporates an improved means for reducing the stress caused at the vicinities of the ball corner portions thereof.

In accordance with the present invention, the above-mentioned object is accomplished by providing a cryogenic liquefied gas tank of the membrane type comprising a rigid outer shell, a compression resistant heat insulating layer at the inside of said outer shell, an inner membranous vessel at the inside of said heat insulating layer, said membranous vessel having rounded corner portions, saddle elements between said heat insulating layer and said membranous vessel for supporting said corner portions of said membranous vessel, and thermosensitive expansion and contraction rod means arranged along the wall of said membranous vessel and adapted to drive said saddle element in accordance with its expansion or contraction due to the change of temperature thereof which reflects the change of temperature of said membranous vessel.

By this arrangement, the saddle element is shifted by the driving rod means in accordance with the change of temperature of the inner membranous vessel so that it can follow the shifting of the corner portion of the membranous vessel due to its expansion or contraction, whereby it is ensured that the saddle element always fits and desirably supports the corner portion of the membranous vessel regardless of the temperature of the membranous vessel thereby avoiding the generation of the high stress at the corner portion of the membranous vessel.

BRIEF DESCRIPTION OF THE DRAWING

The present invention will become more fully understood from the detailed description given hereinbelow and the accompanying drawings which are given by way of illustration only and thus are not limitative of the present invention and wherein:

FIG. 3 is a plan view showing the roof portion of the inner membranous vessel incorporated in the tank shown in FIG. 2;

FIG. 4 is an enlarged cross-sectional view taken along line IV—IV in FIG. 2;

and FIG. 5 is an enlarged vertical sectional view of the bottom ball corner portion of the membranous vessel incorporated in the tank shown in FIG. 2.

DESCRIPTION OF THE PREFERRED EMBODIMENT

Figure 1:
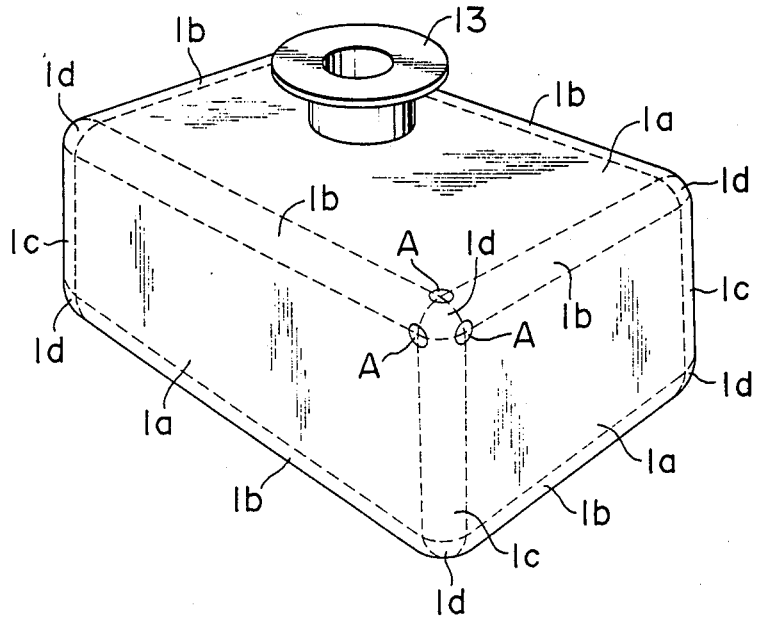
FIG. 1 is a perspective view of an inner membranous vessel having a common hexahedral shape.
Figure 2:
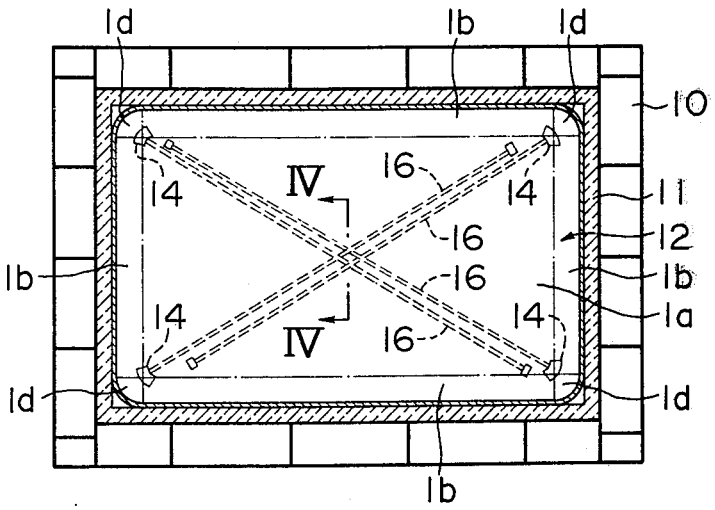
FIG. 2 is a rather diagrammatical horizontal sectional plan view showing an embodiment of the cryogenic liquefied gas tank of the membrane type according to the present invention.

Referring to the drawing, 10 designates an outer shell having a duplicate structure and at the inside of which is provided a compression resistant heat insulating layer 11, and further at the inside of the heat insulating layer is provided an inner membranous vessel 12. The membranous vessel has a hexahedral shape such as shown in FIG. 1 and including the face portions 1*a*, the curved horizontal edge portions 1*b*, the curved vertical edge portions 1*c* and the ball corner portions 1*d*. The inner membranous vessel 12 is provided with a dome 13 as shown in FIGS. 1 and 3.

At each ball corner portion of the inner membranous vessel 12 or, in more detail, at the joining portion of the face portion, the curved edge portions and the ball corner portion such as shown by A in FIG. 1, a saddle element 14 is provided to support the joining portion. Since there are three such joining portions A for each corner portion, three saddle elements 14 are provided for one corner portion, although all of them are not shown in the drawing. The saddle element 14 may be made of a rigid material such as aluminium alloy or hard wood and its supporting face which contacts the inner membranous vessel is formed in a concave shape fitting the convex shape of said joining portion of the membranous vessel. The saddle element 14 is engaged into an end portion of a channel 15 provided in the roof portion, vertical wall portion or bottom wall portion, of the heat insulating layer 11, said channel extending substantially diagonally in these wall portions, and the saddle element is slidable in the diagonal direction in the end portion of the channel. A thermosensitive expansion and contraction rod means 16 is provided in said channel and is connected to the saddle element 14 at one end thereof, while it is anchored to the heat insulating layer at the other end thereof. The thermosensitive expansion and contraction rod means may be a rod or a pipe made of a metal having a relatively large thermal expansion coefficient such as an aluminium alloy. Or alternatively, a piston-cylinder device enclosing a thermally expansive fluid such as oil in the cylinder chamber may be employed for the thermo-sensitive expansion and contraction rod means. By arranging the channel 15 and the rod means 16 in the diagonal directions of the roof portion, side wall portions, or bottom portion of the heat insulating layer, the shifting direction of the saddle element conforms to the direction of expansion and contraction of the corner portion of the membranous vessel. Furthermore, if the channel and the rod means are arranged strictly along the diagonal of the roof portion, vertical wall portion and bottom portion of the heat insulating layer, the largest length is available for the channel and the rod means so that the rod means made of a convenient material will readily be able to provide an expansion and contraction stroke necessary for shifting the saddle element in accordance with the expansion and contraction of the inner membranous vessel. However, when the dome 13 is provided at the roof portion of the inner membranous vessel, the rod means 16 will have to be arranged so as to avoid the dome 13 as shown in FIG. 3.

The behavior of the saddle element 14 will be explained with respect to the saddle element provided for the bottom corner portion of the membranous vessel with reference to FIG. 5.

When the inner membranous vessel 12 is at room temperature, the ball corner portion of the membranous vessel is arranged as shown by solid lines in the figure. Under this condition, the thermosensitive expansion and contraction rod means 16 which is substantially at the same temperature as the membranous vessel 12, expands to drive the saddle element 14 to the position where the concaved upper surface thereof just fits the convex shape of the joining portion of the ball corner portion, the curved edge portions and the face portion, thereby supporting the joining portion in a desireable manner. Under this condition, the hydraulic pressurising test employing water is performed without causing any stress concentration at said joining portion. When said inner membranous vessel 12 is charged with the initial supply of cryogenic liquefied gases, first the membranous vessel contracts under no load condition and takes the contour such as designated by 12'. At the same time the thermosensitive expansion and contraction rod means 16 also contracts due to the cryogenic temperature and draws the saddle element 14 so that it is shifted to the position shown by 14'. When the inner membranous vessel 12 has been charged with a substantial amount of cryogenic liquefied gases, it is expanded by the internal pressure or hydraulic pressure of the liquefied gases and it finally takes the contour shown by 12''. Under this condition, the upper concaved surface of the saddle element 14 closely fits the convex surface of the membranous vessel and supports it in a desirable manner at the joining portion of the ball corner portion, curved edge portions and face portion of the membranous vessel. In this manner, the overstressing of the joining portion during the cryogenic operation of the inner membranous vessel is positively avoided while the danger that the inner membranous vessel is locally damaged by the saddle element during the hydraulic pressurising test performed at room temperature, due to a poor fitting contact with the saddle element, is also avoided.

Although the invention has been shown and described with respect to a preferred embodiment thereof, it should be understood by those skilled in the art that various changes and omissions of the form and detail thereof may be made therein, without departing from the scope of the invention.

I claim:

1. A cryogenic liquefied gas tank of the membrane type comprising a rigid outer shell, a compression resistant heat insulating layer provided at the inside of said outer shell, an inner membranous vessel provided at the inside of said heat insulating layer, said membranous vessel having at least one rounded corner portion which changes its shape in accordance with changes of its temperature, at least one movable saddle element provided between said heating insulating layer and said membranous vessel for supporting said corner portion of said membranous vessel, said saddle element having a supporting face which fits said corner portion in the most favorable manner when it is positioned at a predetermined relation with respect to said corner portion, and thermosensitive expansion and contraction rod means arranged along the wall of said membranous vessel and adapted to drive said saddle element in accordance with its expansion or conraction due to changes of its temperature which reflects changes of the temperature of said membranous vessel, thereby shifting said saddle element so that it is positioned at said predetermined relation with respect to said corner portion regardless of changes of the temperature of said inner membranous vessel.

2. The tank of claim 1, wherein said inner membranous vessel has hexahedral shape and includes substantially flat face portions, curved edge portions and substantially spherical corner portions, said thermosensitive expansion and contraction rod means being arranged along said face portions to be substantially diagonal in said face portions.

3. The tank of claim 1, wherein said heat insulating layer is formed with channels for receiving said saddle elements and said thermosensitive expansion and contraction rod means.

4. The tank of claim 1, wherein the thermal expansion and contraction of said thermosensitive expansion and contraction rod means are adjusted by the selection of the material and the dimensions of said thermosensitive expansion and contraction rod means in a manner such that when said thermo-sensitive expansion and contraction rod means is at room temperature, it drives said saddle element to a position where it fits said corner portion of said membranous vessel expanded at room temperature and by the internal pressure applied for the hydraulic pressurising test and that when said thermosensitive expansion and contraction rod means is at the cryogenic temperature of the cryogenic liquefied gases loaded in said membranous vessel, it drives said saddle element to a position where it fits said corner portion of said membranous vessel contracted at said cryogenic temperature while expanded by the internal pressure applied by the cryogenic liquefied gases loaded in said membranous vessel.

* * * * *